US010994217B2

(12) United States Patent
Lopez Diaz et al.

(10) Patent No.: US 10,994,217 B2
(45) Date of Patent: May 4, 2021

(54) LATEX BALLOON WITH METALIZED MIRRORED FINISHING

(71) Applicant: LATEX OCCIDENTAL EXPORTADORA S.A. DE C.V., Guadalajara (MX)

(72) Inventors: Carlos Lopez Diaz, Guadalajara (MX); Gerardo Alarcon Garza, Guadalajara (MX)

(73) Assignee: LATEX OCCIDENTAL EXPORTADORA S.A. DE C.V., Guadalajara Jalisko (MX)

( * ) Notice: Subject to any disclaimer, the term of this patent is extended or adjusted under 35 U.S.C. 154(b) by 0 days.

(21) Appl. No.: 16/552,566

(22) Filed: Aug. 27, 2019

(65) Prior Publication Data

US 2021/0016195 A1 Jan. 21, 2021

(30) Foreign Application Priority Data

Jul. 18, 2019 (MX) ..... MX/a/2019/008605

(51) Int. Cl.
*A63H 27/00* (2006.01)
*A63H 27/10* (2006.01)

(52) U.S. Cl.
CPC ..... *A63H 27/10* (2013.01); *A63H 2027/1025* (2013.01)

(58) Field of Classification Search
CPC ..... A63H 27/10; A63H 2027/1025
See application file for complete search history.

(56) References Cited

U.S. PATENT DOCUMENTS 1,484,919 A * 2/1924 Witten ..... B29D 22/00 264/78
1,593,703 A * 7/1926 Morr ..... B29D 22/02 446/220
2,295,708 A * 9/1942 Bitter ..... A63H 27/10 446/220
4,884,990 A * 12/1989 Lovik ..... A63H 27/10 446/220
5,383,806 A * 1/1995 Prater ..... A63H 27/10 427/393.5
5,492,500 A * 2/1996 Sinclair ..... C08J 7/0427 446/220
6,280,673 B1 * 8/2001 Green ..... A61F 13/041 264/255
8,399,030 B1 3/2013 Nur
8,399,080 B2 * 3/2013 Chicarella ..... B32B 27/20 428/35.7

(Continued)

FOREIGN PATENT DOCUMENTS

DE 102006009030 B3 6/2007
JP H06171043 A 6/1994

*Primary Examiner* — Nini F Legesse
(74) *Attorney, Agent, or Firm* — Jason P. Mueller; FisherBroyles, LLP

(57) ABSTRACT

The present disclosure refers to a latex balloon with a particular finishing as its surface is highly reflective, and with metallized tones. The balloon of the present disclosure is manufactured in at least two layers. The instant disclosure provides a balloon with metallized mirrored finishing which may also be added with several colors. Additionally, the reflective power of the balloon surface is enhanced. In addition, methods for manufacturing the present balloon are provided.

6 Claims, 4 Drawing Sheets

(56) References Cited

U.S. PATENT DOCUMENTS

| | | | | |
|---|---|---|---|---|
| 2003/0157864 | A1* | 8/2003 | Blackman | A63H 27/10<br>446/220 |
| 2011/0229668 | A1* | 9/2011 | Doyle | C08J 5/02<br>428/35.5 |
| 2012/0118502 | A1* | 5/2012 | Dicristofaro | B32B 37/12<br>156/297 |
| 2019/0192984 | A1* | 6/2019 | Holmes | C08L 7/02 |

* cited by examiner

LATEX BALLOON WITH METALIZED MIRRORED FINISHING

CROSS-REFERENCE TO RELATED APPLICATIONS

This application claims priority to Mexican Patent Application No. MX/a/2019/008605, filed Jul. 18, 2019, the entire contents of which are incorporated herein by reference.

FIELD OF THE DISCLOSURE

The present disclosure refers to a latex balloon with a particular finishing as its surface is highly reflective, and with metallized tones.

The balloon of the present disclosure is manufactured in at least two layers.

The instant disclosure provides a balloon with metallized mirrored finishing, which may also be added with several colors. Additionally, the reflective power of the balloon surface is enhanced.

In addition, methods for manufacturing the present balloon are provided.

The balloon may be used by companies of the balloon manufacturing and/or printing field, licensors, companies or businesses focused on buying, distribution and/or exhibition of balloons and or party items, or individuals or companies engaged in decoration of different kinds of events (exhibitions, parties, conventions, among other events).

The prior art includes documents that disclose metalized balloons such as those shown in Japanese Patent No. JPH06171043 A, which claims a balloon made of a composed film consisting of a biaxially stretched laminated film based on polyamide which has a structure containing three layers of polymer as a raw material, and a thermosealing layer. The balloon disclosed in said patent is made of a composed film consisting of a biaxially stretched laminated film based on polyamide (or base film), which has a structure composed by at least two different layers out of layers (a), (b), and (c), and a thickness of 10-30 μm, and a thermosealing layer 2 with a thickness of 10-30 μm. Polymer A is an aromatic polyamide containing 70 mole % or more of a polyamide structural unit in molecular chain.

However, said balloon of Japanese Patent No. JPH06171043 A is not a multilayer balloon, and it does not disclose or suggest in any way the vacuum deposition of metals or metallic pigments such as aluminum.

German Patent No. DE102006009030B3 discloses an inflatable balloon (1) having a luminous visualization surface of electroluminescent layer (EL-(2)). A part of the balloon's envelopment is cut, and for that, the layer EL-(2) is integrated or constitutes the whole envelopment of the balloon; or layer (2) is fixed by means of a suitable connection device to the hermetic gas-proof balloon envelope in the internal face of the balloon envelope.

Said balloon of German Patent No. DE102006009030B3 has several membranes and metallic coverings; however, it is not a latex balloon, so the processes and components necessary to carry out the invention change radically from the methods disclosed herein.

U.S. Pat. No. 8,399,080 B2 claims a long-life balloon made by lamination. The lamination includes a polyester film with a total thickness of 4 to 12 μm. The polyester film includes a polyester central layer biaxially oriented, and at least one layer of amorphous copolyester. Said lamination also includes a sealing layer and a gas-proof barrier layer on the opposite side of the polyester layer of said sealing layer.

The oxygen transmission rate of the balloon is lower than 0.1 cc/100 sqin/day (0.1 cc/645 $cm^2$/day); the binding resistance of the gas-proof barrier layer to the surface of the polyester film is more than 300 g/$in^2$ (46.5 g/$cm^2$) under dry conditions; a sealing resistance of the balloon higher than 3.5 kg/$in^2$ (0.54 kg/$cm^2$); and a floating time of the balloon longer than 20 days.

However, the balloon disclosed in said U.S. Pat. No. 8,399,030 B2 is not a multilayer laminated balloon with layers metallized by vapor deposition, and this balloon is not made of latex.

Evidently, none on the patents found discloses that the first layer has a mirror-type finishing as a background and a second layer has a desired color. Additionally, the proportions of the layers are not disclosed. Also, the way in which the adhesion between layers is made is not disclosed, specifically for latex.

SUMMARY OF THE DISCLOSURE

An object of the instant disclosure is to provide a balloon with metallized mirroring finishing of multiple layers of several colors, and methods for the manufacturing thereof.

DETAILED DESCRIPTION OF THE DISCLOSURE

The present disclosure provides a method of manufacturing a latex balloon that may be formed with two layers, where said balloon is formed by providing a first pigmented layer that represents between 50 and 70 weight percent of the balloon, and providing a second colored layer that represents between 30 and 50 weight percent of the balloon. With these proportions, a balloon composition that reflects a great amount of light with metallized effect is obtained because of said first layer, while allowing, in addition, to visualize the color added to said second layer.

In a disclosed embodiment, both of the layers are overlaid such that the first layer is made on the outer side second layer.

The chemical-physical conditions necessary to use commercial pigments in a latex solution have already been developed. Said pigments are commonly used for other applications in non-related industries, such as the automotive industry, in order to obtain metallized finishings.

In addition, the instant disclosure uses aluminum pigments that are applied on said first layer to obtain a metalized effect thereon. In a disclosed embodiment, said first layer comprises up to 50 percent of pigment.

In alternative embodiments, the method includes providing multiple layers, one onto another, wherein the proportion between pigmented layers and colored layers is maintained. Thus, the layers overlying allows a bigger reinforcement between the balloon's layers, which affects positively the reflective and coloring effect of each layer.

In alternative embodiments, in a step prior to the application of the second layer, the balloon is subjected to a bath with saline, such that the balloon is vulcanized as an intermediate step before binding both of the layers. This optional vulcanizing provides the balloon layers with a higher resistance.

Additionally, the method involves the inclusion of visual finishing materials to the layers, such as glitter, or color combinations.

Figure 1:
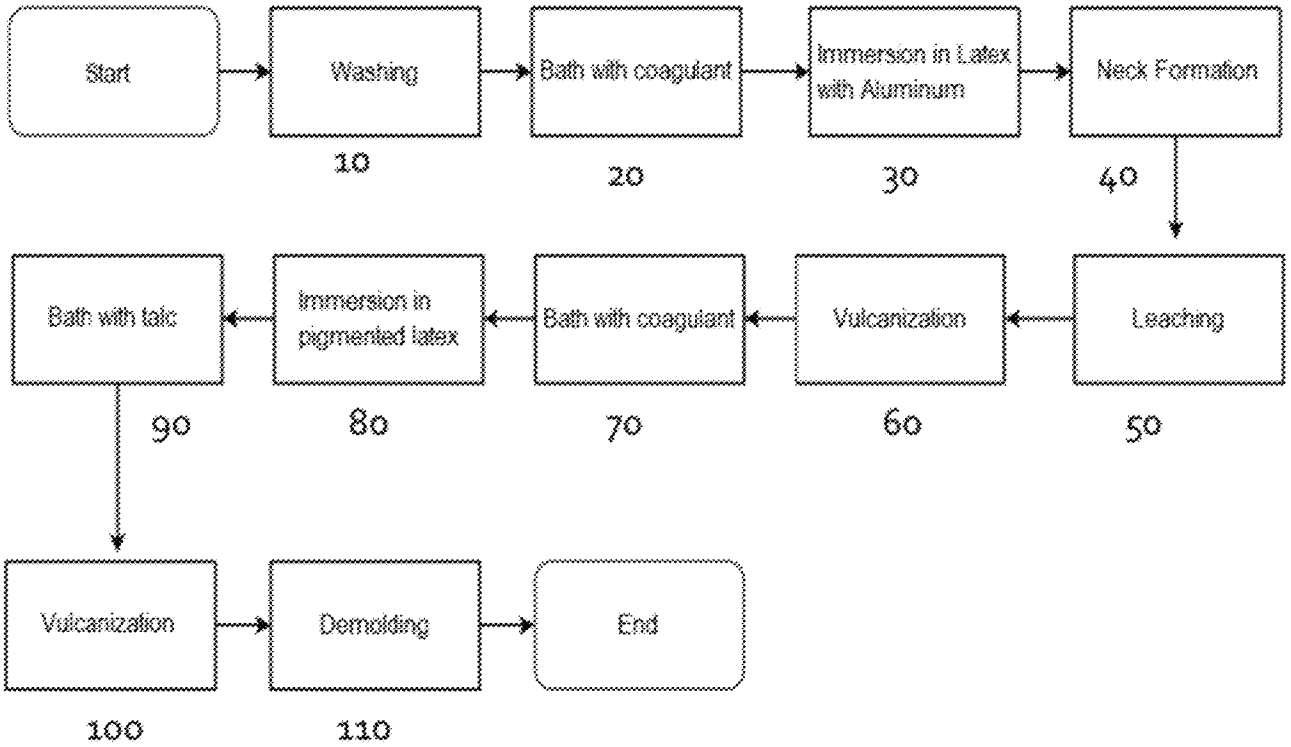
FIG. 1 shows a block diagram that details the manufacturing process of a latex multilayer balloon with metallized mirrored finishing.
Figure 2:
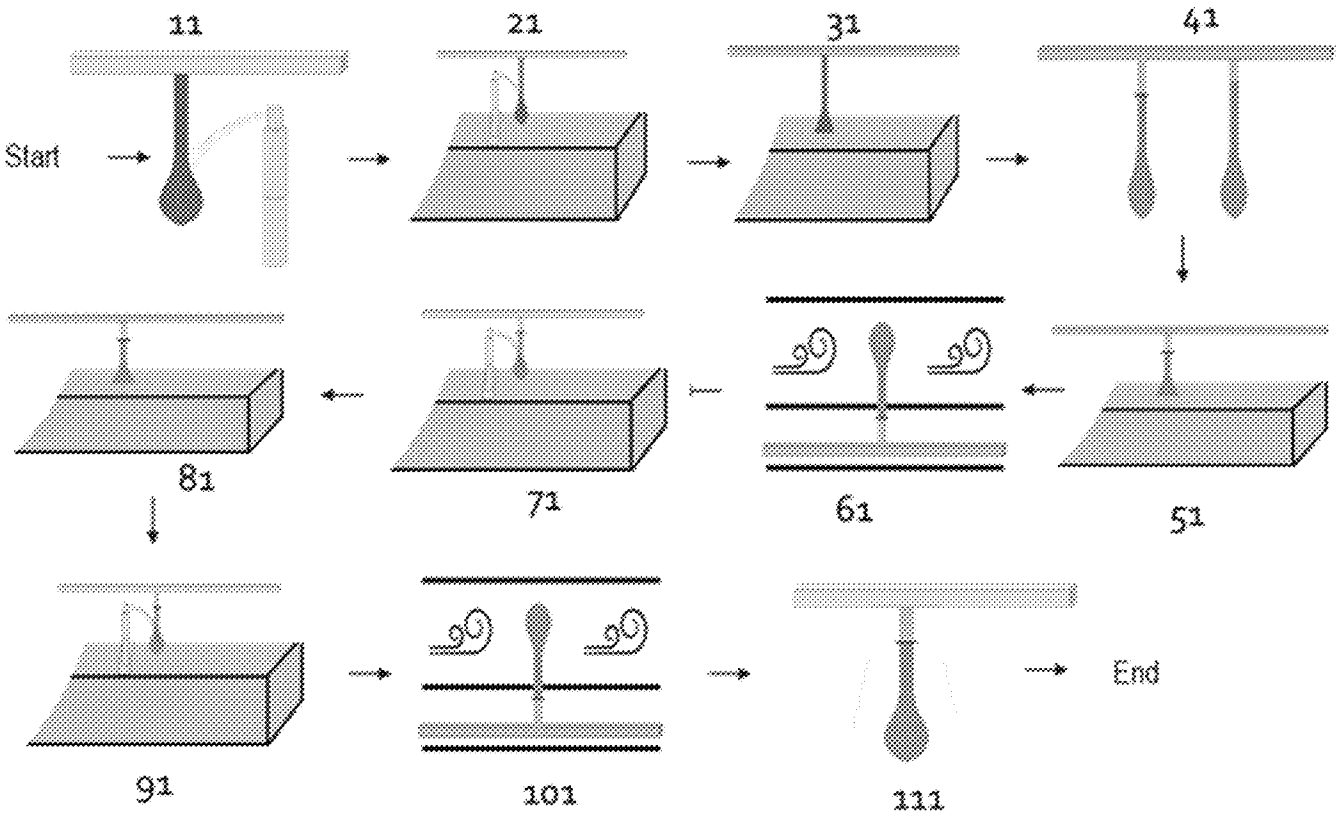
FIG. 2 shows a diagram of the steps of the manufacturing process of a latex multilayer balloon with metallized mirrored finishing.

As shown in FIG. 1, the process includes a set of steps in order to carry out the disclosed method, and to achieve the desired results for the balloon. In addition, said steps are schematically shown in FIG. 2. Generally, the steps comprise:

Washing (10, 11): This step consists of a mold washing, specifically, it refers to a chemical and mechanical washing so as to eliminate any residual materials used in the process. A good mold washing allows obtaining a more uniform film in the balloon.

Coagulant bath (20, 21): The balloon mold is washed with a saline dispersion that contains at least one demolding agent. A uniform bath allows obtaining a balloon film with no defects of appearance. In addition, this step allows limiting of the weight variation.

Immersion in latex with aluminum (30, 31): The mold is immersed in a high-vacuum bath with pigmented latex and aluminum, remaining therein for a definite time. Said immersion allows obtaining a film that is uniform in weight, color, and thickness, giving to the balloon a good appearance.

Neck formation (40, 41): With mechanical aid, necks are formed in the moistened latex film. The neck gives the balloon support while inflating, and is an aesthetic factor for balloons.

Leaching (50, 51): Mold with the moistened latex film is dipped in a water bath, staying there for some time. A good leaching makes possible to eliminate the excess of humectants used in the process, as well as to reduce the amount of water-soluble nitrosamines and proteins.

Vulcanizing (60, 61): The mold with the moistened latex film is introduced to the oven to dry said film and to carry out the vulcanization reaction. Vulcanization allows the balloon to get suitable mechanical properties, that make possible to meet the functions thereof.

Coagulant bath (70, 71): The mold is subjected to a bath with a saline dispersion. A uniform bath allows to obtain a balloon film with no defects of appearance, besides, this step allows to decrease weight variation.

Immersion in pigmented latex (80, 81): The mold is subjected to an immersion bath with pigmented latex, staying a definite time therein. This immersion makes possible to obtain a film with uniform weight, color, and thickness, giving the balloon a suitable appearance.

Talc bath (90, 91): The mold with moistened latex film is introduced into a bath with an anti-adherent dispersion, preferably talc. This process allows for demolding the balloon with no deformations.

Vulcanization (100, 101): The mold with moistened latex film is introduced again into an oven in order to dry the film and to carry out the vulcanization reaction. This step allows the balloon to get suitable mechanical properties, that make possible to meet the functions thereof.

Demolding (110, 111): Demolding the vulcanized balloon.

A latex balloon with metallized mirrored finishing manufactured by the method before mentioned is also disclosed. Said balloon has the particularity of being formed by multiple layers, such as, for example, two layers; however, no balloon of the prior art has the highly reflective metallized finishing disclosed herein. Said finishing is made of two particular layers, which make up the balloon, and have the following characteristics: the disclosed balloon comprises a first pigmented layer that represents between 50 and 70 weight percent of the balloon, and a second colored layer that represents between 30 and 50 weight percent of said balloon. Said first layer is formed on the outer side of the second layer. Also, said first layer comprises up to 50 percent of pigment, wherein said pigment is an aluminum pigment.

Figure 3:
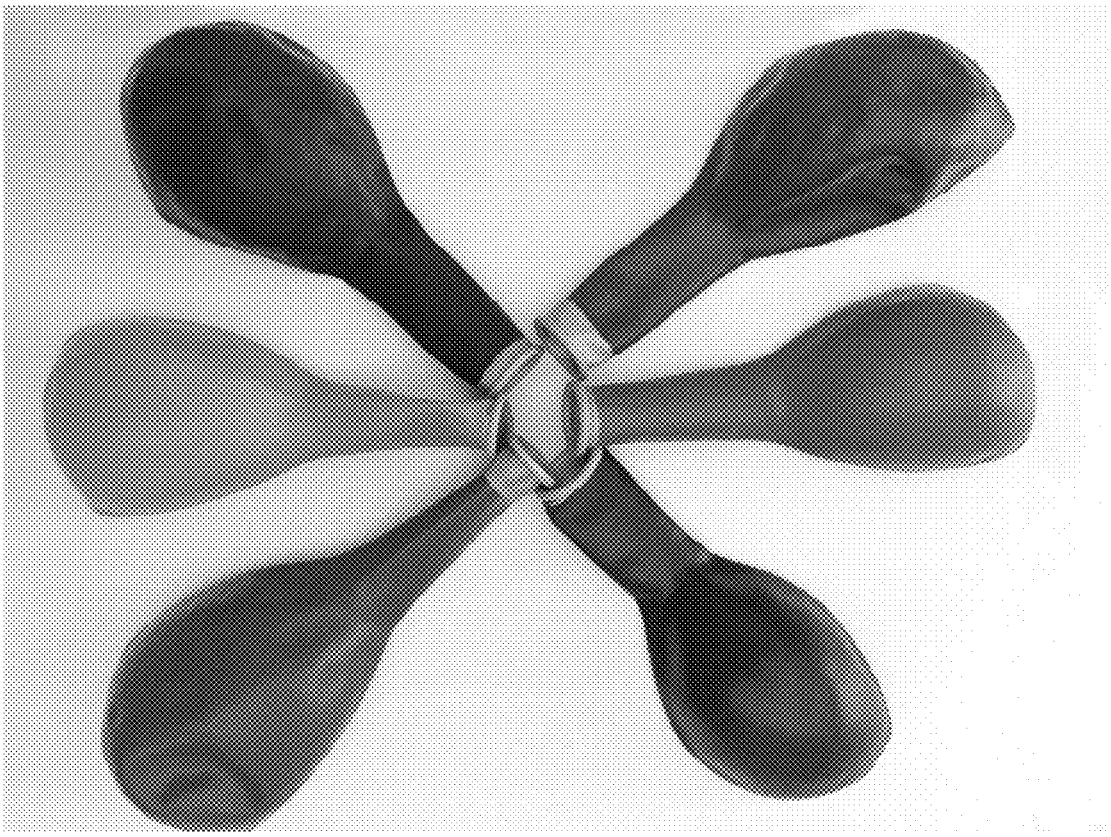
FIG. 3 shows a photograph of non-inflated balloons made with the process of the instant disclosure.
Figure 4:
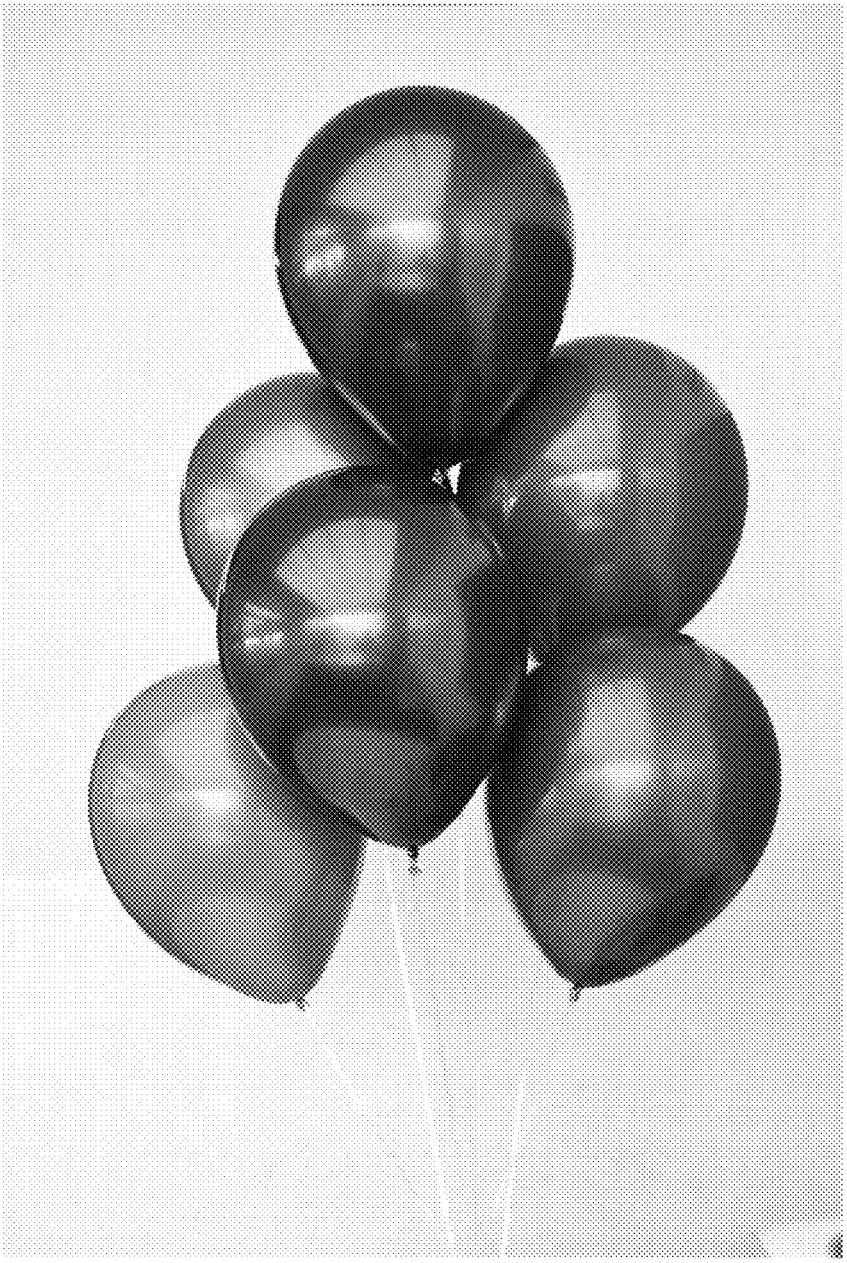
FIG. 4 shows a photograph of inflated balloons made with the process of the instant disclosure.

As shown in FIG. 3, the resultant balloon 300 may be appreciated in its non-inflated state as a balloon with a metallic inside, and colored with no metallic effect outside; however, in the inflated state, as shown in FIG. 4, the layers expand and transparency allows to see a metallized effect of the first layer and the color of the second layer of the balloon 300.

In other embodiments, the balloon comprises multiple layers, one onto another, wherein the proportion between pigmented layers and colored layers is maintained.

Additionally, the balloon may be subjected to a bath with saline solution, so as to vulcanize said balloon. Said vulcanization increases the balloon's resistance.

Finally, the balloon may also composed by materials for visual finishing, which are added to the layers.

What is claimed is:

1. A method for manufacture of a latex balloon having two layers, comprising:

washing a mold;

bathing the mold in a coagulant agent;

carrying out at least one first immersion in a first latex bath;

forming a neck of the mold;

immersing the mold with moistened latex film in a water bath, and maintaining the mold therein for a determined time, so as to form a leaching;

carrying out a vulcanization of the mold in an oven;

bathing the mold in a coagulant agent;

carrying out at least a second immersion in a second latex bath;

bathing the mold in talc;

carrying out a second vulcanization of the mold in the oven;

demolding the mold, creating a balloon product;

wherein the first latex bath is an aluminum latex bath;

wherein the second latex bath is a colored latex bath;

wherein the first latex bath provides a first pigmented layer in aluminum latex that represents between approximately 50 weight percent and approximately 70 weight percent of the balloon;

wherein the second latex bath provides a second layer with color that represents between approximately 30 weight percent and approximately 50 weight percent of the balloon;

wherein said first pigmented layer comprises up to approximately 50 percent of a pigment.

2. The method according to claim 1, further comprising a third immersion in a third latex bath, and wherein the third latex bath is in a coagulant agent, thus forming layers onto one another, wherein the approximately proportion between the first pigmented layer and the second colored layer is maintained.

3. The method according to claim 1, further comprising adding materials for visual finishings.

4. A latex balloon with metallized mirrored finishing, comprising:

at least one first pigmented metallized layer that represents between approximately 50 weight percent and approximately 70 weight percent of the balloon, wherein the first pigmented metallized layer is developed from an aluminum latex bath applied to a balloon mold washed in a coagulant agent; and at least a second colored layer that represents between approximately 30 weight percent and approximately 50 weight percent of the balloon, wherein the second colored layer is developed from a colored latex bath applied to the balloon mold following (a) immersion of the washed balloon mold in the aluminum latex bath, creating a moistened aluminum mold, (b) immersing the moistened aluminum mold in a water bath, creating a leached mold, (c) vulcanizing the leached mold in an oven, creating a vulcanized mold, and (d) bathing the vulcanized mold in a second coagulant bath.

5. The balloon according to claim 4, further comprising multiple pigmented layers and multiple colored layers, one onto another, wherein the approximate proportion between the pigmented layers and the colored layers is maintained.

6. The balloon according to claim 5, further comprising materials for visual finishings added to said layers.

* * * * *